US010495356B2

(12) United States Patent
Ye

(10) Patent No.: US 10,495,356 B2
(45) Date of Patent: Dec. 3, 2019

(54) KNAPSACK WITH A COOLING DEVICE

(71) Applicant: DongGuan Quanchuang Handbag Material Co., Ltd, Guangdong (CN)

(72) Inventor: Panquan Ye, Dongguan (CN)

(73) Assignee: DONGGUAN QUANCHUANG HANDBAG MATERIAL CO., LTD, Dongguan (CN)

( * ) Notice: Subject to any disclaimer, the term of this patent is extended or adjusted under 35 U.S.C. 154(b) by 89 days.

(21) Appl. No.: 15/716,455

(22) Filed: Sep. 26, 2017

(65) Prior Publication Data

US 2019/0093929 A1 Mar. 28, 2019

(51) Int. Cl.

| | |
|---|---|
| ***F25B 21/02*** | (2006.01) |
| ***A45F 3/04*** | (2006.01) |
| ***A45F 3/00*** | (2006.01) |

(52) U.S. Cl.

CPC ..... *F25B 21/02* (2013.01); *A45F 3/04* (2013.01); *A45F 2003/003* (2013.01); *A45F 2003/045* (2013.01); *F25B 2321/023* (2013.01); *F25B 2321/0251* (2013.01)

(58) Field of Classification Search

CPC ..... F25B 21/02; A45F 3/04

USPC ..... 62/3.26

See application file for complete search history.

(56) References Cited

U.S. PATENT DOCUMENTS

| | | | | |
|---|---|---|---|---|
| 5,630,537 | A * | 5/1997 | Sciacca | A01K 97/06 206/561 |
| 7,249,464 | B1 * | 7/2007 | Watson | A45F 3/04 62/259.3 |
| 2004/0035143 | A1 * | 2/2004 | Mogil | A45C 7/0077 62/457.2 |
| 2005/0132468 | A1 * | 6/2005 | Lundgren | A42B 3/28 2/171.3 |
| 2009/0199571 | A1 * | 8/2009 | Creech | A61F 7/02 62/3.2 |
| 2012/0227432 | A1 * | 9/2012 | Creech | A41D 13/0053 62/259.3 |
| 2012/0277906 | A1 * | 11/2012 | Fassberg | A23G 9/045 700/244 |
| 2013/0019611 | A1 * | 1/2013 | Sims | F25B 21/02 62/3.3 |
| 2015/0075185 | A1 * | 3/2015 | Sims | F28F 1/00 62/3.5 |
| 2015/0323209 | A1 * | 11/2015 | Khiani | G05B 15/02 700/276 |
| 2017/0203632 | A1 * | 7/2017 | Westendarp | B60H 1/00378 |

(Continued)

*Primary Examiner* — Henry T Crenshaw

(57) ABSTRACT

The present invention provides a knapsack with a cooling device. The knapsack comprises a knapsack body and a cooling device. The cooling device includes an electric motor, a radiating assembly and a circulating pipe. The electric motor is electronically connected with the radiating assembly. The radiating assembly is communicated with the circulating pipe. The circulating pipe consists of multiple curved U type units that connects with each other. The back of the knapsack body is provided with an interlayer. The multiple curved U type units of the circulating pipe are tiled in the interlayer. The cooling device is disposed in the knapsack to reduce the temperature of the back of the knapsack and keep it cool. It resolves the problem that the wearer's back feels hot and sweaty when the wearer uses the knapsack in hot day.

7 Claims, 4 Drawing Sheets

(56) References Cited

U.S. PATENT DOCUMENTS

2018/0142924 A1* 5/2018 Limon ..... A41D 13/0025
2018/0177250 A1* 6/2018 Vanlangendonck .... F25B 21/04

* cited by examiner

KNAPSACK WITH A COOLING DEVICE

FIELD OF THE INVENTION

The invention relates to the technology field of knapsacks, more particularly relates to a knapsack with a cooling device.

BACKGROUND OF THE INVENTION

Knapsack is one of essential personal belongings when people walk, hike and climb mountains, etc. Nowadays knapsack generally contacts directly with the knapsack's back, the knapsack is airtight, therefor it can not heat out, so that the knapsacker's back is sultry and sweat, it is very uncomfortable. To the end, people have developed cool knapsacks, for example CN00224778.X discloses a cooling massage knapsack comprising a bag body, a hollow slice, a plastic pipe, thread, buttons and rings, its characteristics is that when the knapsack is used, the air can circulate in the space among the hollow slice so as to play a cooling effect. For example, CN201520258085.3 discloses a cooling knapsack device, the knapsack is carried on knapsacker's shoulders with two straps, its structure consists of a pair of cross bars and a pair of straight rods, the pair of cross bars are respectively fixed on the upper part of the back of the knapsack and the lower part of the back of the knapsack, the pair of straight rods are respectively arranged at the left part of the pair of cross bars and the right part of the pair of cross bars, the straight rods are protruded outwards with a plurality of supporting blocks, the supporting blocks can be moved up and down and positioned along the straight rods and be fixed on them, what's more, the straight rods can also be moved left and right and positioned along the cross bar so as to adjust the position easily. The existing hard shell knapsack can be replaced by a frame support with a cross bar and a straight rod, which not only reduces weight but also has the benefit of protecting the goods in the knapsack from being damaged by pressure. In addition because of the spacing structure between the frame support and the knapsack it has the function of ventilation. Using the knapsack, the knapsacker will feel comfortable, cool and relief G-forces. It improves the using effect of the knapsack.

Although these knapsack solves the problems that the knapsack sticks the back of knapsacker at hot day, causing the knapsacker back hot, the cooling effect of these knapsack is not obvious. Especially when some articles that needed to be kept at low temperature are placed in the knapsack, it can not meet the requirement of freezing.

SUMMARY OF THE INVENTION

In order to overcome the shortcomings of the prior art, the present invention provides a knapsack with a cooling device. The cooling device is accommodated in the knapsack, it can reduce the temperature of the back of the knapsack and keep it cool. It solves the problem that the back of the wearer feels hot and sweaty when the wear uses the knapsack in hot day.

The technical proposals in the present invention are as followings: A knapsack with a cooling device, comprises a knapsack body and a cooling device, the cooling device comprises a semiconductor chilling plate, a radiating assembly, a circulating pipe, a tank and a circuit board; the circuit board is externally connected with a power supply; the circuit board is electronically connected with the semiconductor chilling plate and the radiating assembly; the semiconductor chilling plate is disposed at one side of the tank to cool the liquid in it; the radiating assembly is disposed at one side of the semiconductor chilling plate to dissipate heat, the tank is connected with the circulating pipe; the circulating pipe is composed by multiple curved U type units that are connected with each other; the back of the knapsack body is provided with an interlayer; the multiple curved U type units are tiled in the interlayer.

The radiating assembly comprises a micro fan, a micro liquid pump and a radiator; the circuit board is electrically connected with the micro fan and the micro liquid pump; the two ends of the circulating pipe are respectively connected with the tank and the micro liquid pump, the micro liquid pump is connected with the tank; the power supply drives said micro fan to rotate so as to cool the radiator; the radiator cools the semiconductor chilling plate; the micro liquid pump drives liquid to circulate in the tank and the circulating pipe.

The radiating assembly also comprises a shield; the radiator, the micro liquid pump and the tank are contained in the shield; the shield is provided with fan mounting holes, the micro fan is installed on the fan mounting holes and disposed on the outside of the radiator.

A water inlet is disposed on the tank.

The circulating pipe is also provided with shoulder branch pipes connected with it, the knapsack is provided with shoulder belts; the back of the shoulder belt, on the side closing to wearer's body, is provided with a interlayer of a shoulder belt; the shoulder branch pipes are contained in the interlayer of the shoulder belt.

The circulating pipe is also provided with waist branch pipes connected with it; the knapsack is provided with waist band; the back of the waist band, on the side closing to wearer's body, is provided with a waist interplayer; the waist branch pipes are contained in the waist interlayer.

The cooling device also has a temperature sensor, the circuit board is provided with a control system, the temperature sensor detects the temperature in the tank is lower or higher than a setting value, the control system disconnects or connects the electrical connection between the circuit board and the semiconductor chilling plate.

The circuit board is provided with variable pressure USB connecting line, which is externally connected with a movable power supply.

The inside of the knapsack body is equipped with an interlayer which separates the lumen of the knapsack into a upper chamber and a lower chamber; the left side of the knapsack and the right side of the knapsack are respectively provided with a left zipper and a right zipper at the low chamber; the semiconductor chilling plate, the radiating assembly, the tank and the circuit board are accommodated in the lower chamber.

The advantages of the present invention are as follows: the knapsack with a cooling device, the curved circulating pipe is arranged in the interlayer at the back of the knapsack, the liquid of the tank is cooled by the circulating pipe, the radiating assembly and the micro fan, the liquid is driven by the micro liquid pump to circulate in the tank and the circulating pipe so as to reduce the temperature at the back of the knapsack and keep the wearers' back cool when the wearer uses the knapsack.

EMBODIMENTS

In order to describe the technical purpose and technical effect of the invention clearer, The followings will further describe the present invention combined with the embodiments, which are the preferable embodiments in the present invention.

It should be understood that the specific embodiments described herein are only used to interpret the present invention and are not intended to define the present invention.

Figure 1:
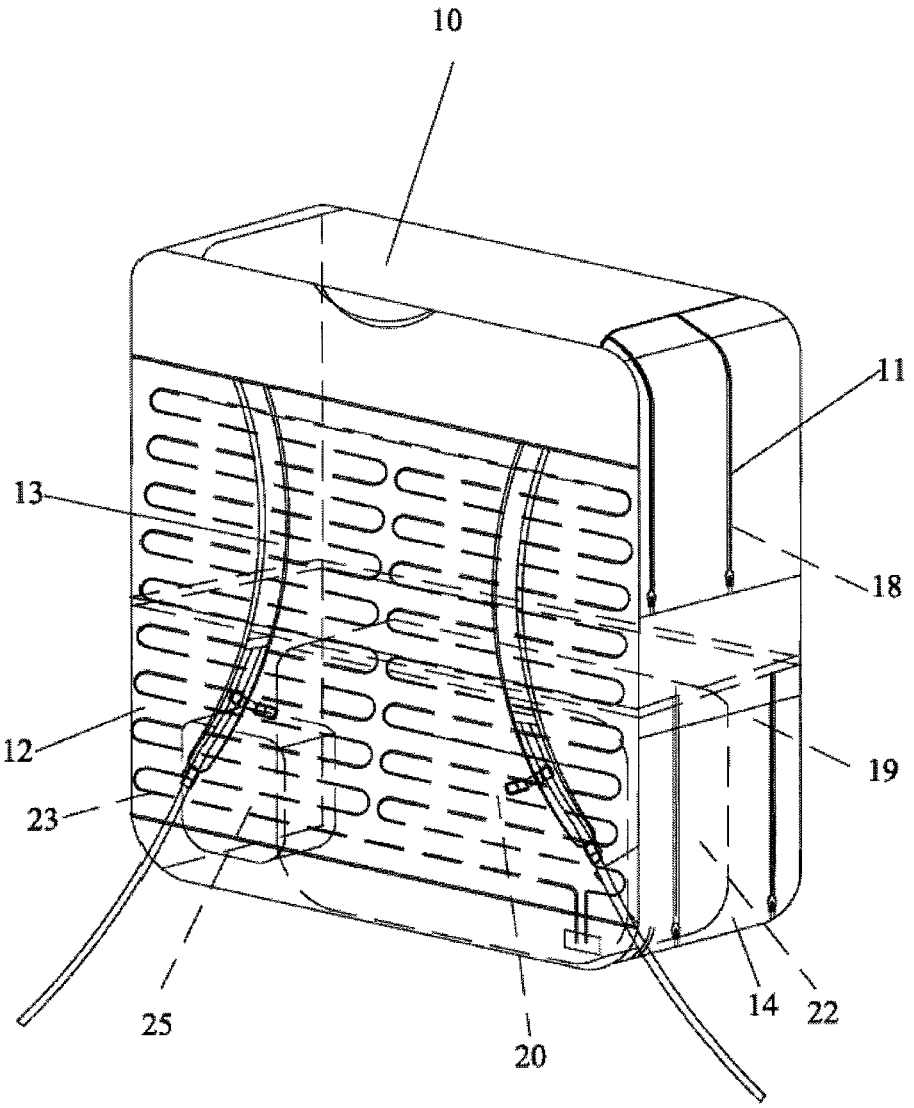
FIG. 1 shows a schematic view of the knapsack with a cooling device in the present invention.
Figure 2:
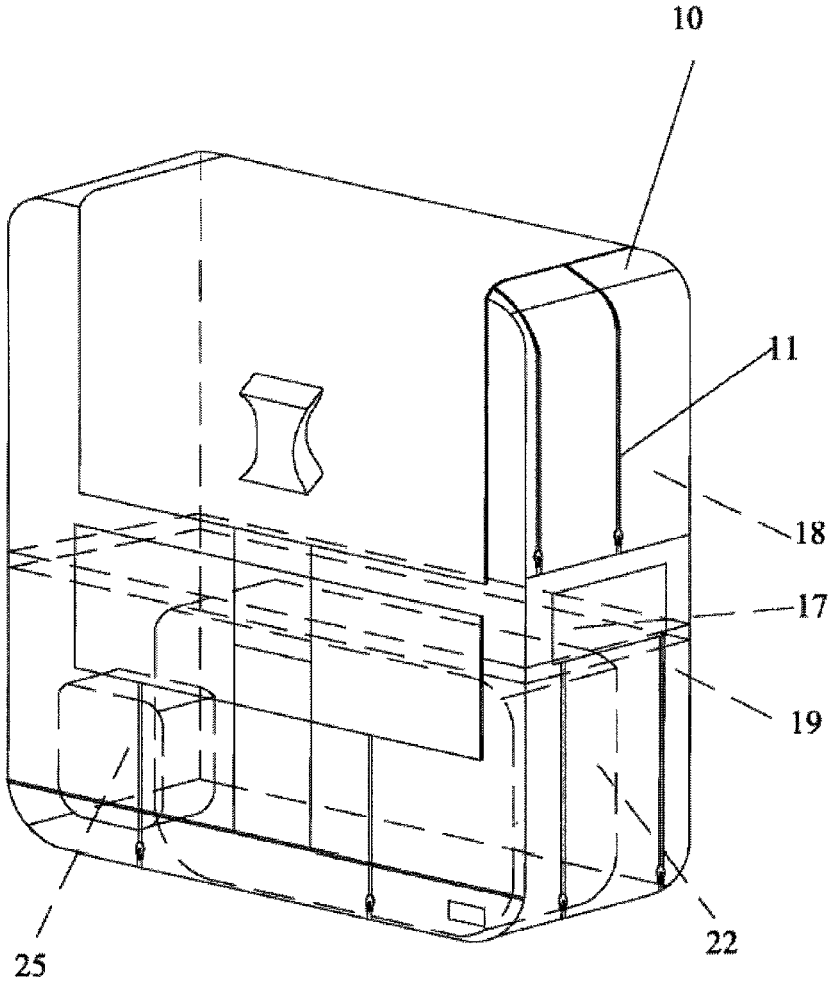
FIG. 2 is another schematic view of the knapsack with a cooling device in the present invention.

Referring to FIG. 1 and FIG. 2, the knapsack with a cooling device comprises a knapsack body 10 and a cooling device 20. The knapsack body 10 has general external structure the same as the conventional knapsack body, including a few chambers, which are separated by cloth substrates, for storing objects. Each chamber is provided with a zipper opening 11. The back of the knapsack is provided with shoulder strap 13 and waist band 14. The front face of the knapsack is provided with a lock catch and a locking band.

Figure 3:
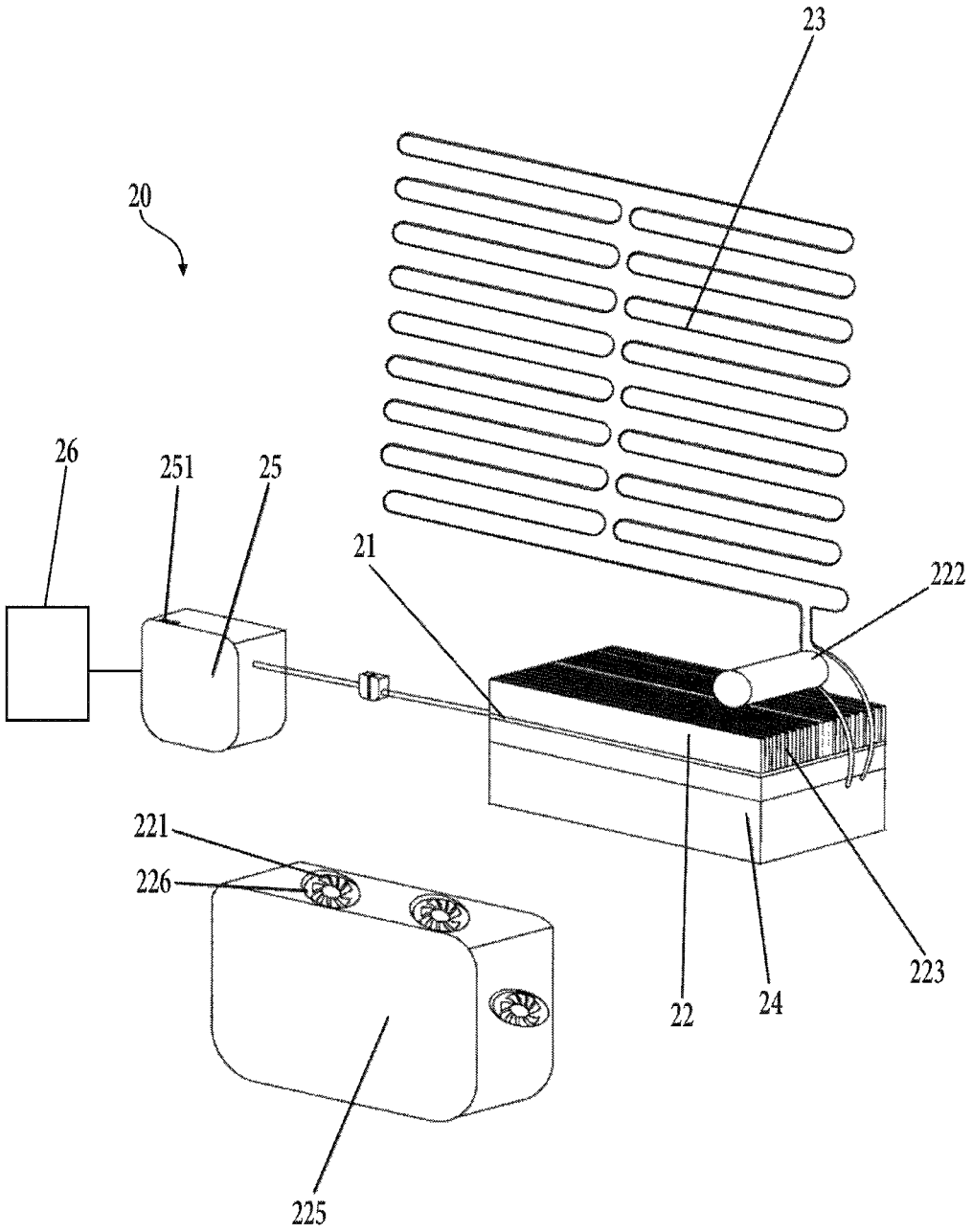
FIG. 3 is a schematic view of the cooling device in the knapsack in the present invention.

Referring to FIG. 3, the cooling device 20 comprises a semiconductor chilling plate 21, the radiating assembly 22, the circulating pipe 23, the tank 24 and the circuit board 25. The circuit board 25 externally connects with a power supply 26 and electrically connected with the radiating assembly 22 and the semiconductor chilling plate 21; the semiconductor chilling plate 21 is disposed on the side of the tank 24 to cool the liquid in it. The radiating assembly 22 is disposed on the side of the semiconductor chilling plate 21 to dissipate heat. The circulating pipe 23 is composed by multiple curved U type units that are connected with each other; the back of the knapsack body 10 is provided with an interlayer 12; the multiple curved U type units of the circulating pipe 23 are tiled in the interlayer 12. When the cooling liquid enters the circulating pipe 23 in the interlayer 12, it reduces the temperature at the interlayer 12. When the knapsack is used, the back of the knapsack contacts with the wearer's back, to keep the wearer's back cool.

Preferably, the circuit board 25 is provided with a variable pressure USB interface 251. The USB interface 251 is contacted with a mobile power supply, it can increase 6V voltage to 12V or above.

Preferably, referring to FIG. 3, the radiating assembly 22 includes a micro fan 221, a micro liquid pump 222 and a radiator 223. The circuit board 25 is electrically connected with the micro fan 221 and the micro liquid pump 222. The two ends of the circulating pipe 23 are respectively connected with the tank 24 and the micro liquid pump 222, the micro liquid pump 222 is connected with the tank 24; the power supply 26 drives the micro fan 221 to rotate by the circuit board 25 as to cool the radiator 223; the radiator 223 cools the liquid in the tank 24. The micro liquid pump 222 drives the liquid to circulate in the tank 24 and the circulating pipe 23, thus, the liquid temperature in the circulating pipe 23 in the interlayer is kept lower than the ambient temperature. The tank 24 is provided with a water inlet, which is facilitated to add liquid to the tank.

Preferably, the radiating assembly 22 also includes the shells 225, the shells 225 is made from waterproof material. The radiator 223, the micro liquid pump 222 and the tank 24 are accommodated in the shells 225. The shells 225 is provided with a fan mounting hole 226. The micro fan 221 is mounted on the fan mounting hole 226 at the outside of the radiator 223. The radiator 223 is made from aluminum.

It should be understood that the present invention only defines that the circulating pipe 23 is arranged at the interlayer in the back of the knapsack, it does not define the position of the other parts of the cooling device. These parts can be arranged in the inner part or the out part of the knapsack body according the requirement. In one embodiment of the present invention, referring to FIG. 1 and FIG. 2, the interlayer 17 is arranged in the knapsack body 10 to separate the inner cavity of the knapsack into the upper chamber 18 and the lower chamber 19. The left side and the right side of the knapsack body is respectively provided with the left zipper and the right zipper 14 at the lower chamber 19. The zipper is used to open and close the lower chamber 19. In another embodiment of the present invention, an interlayer 17 is arranged in the knapsack body 10 to separate the inner cavity of the knapsack into the front chamber and the rear chamber. The semiconductor chilling plate 21, the radiating assembly 22, the tank 24 and the circuit board 25 are accommodated in the front chamber or the rear chamber.

Figure 4:
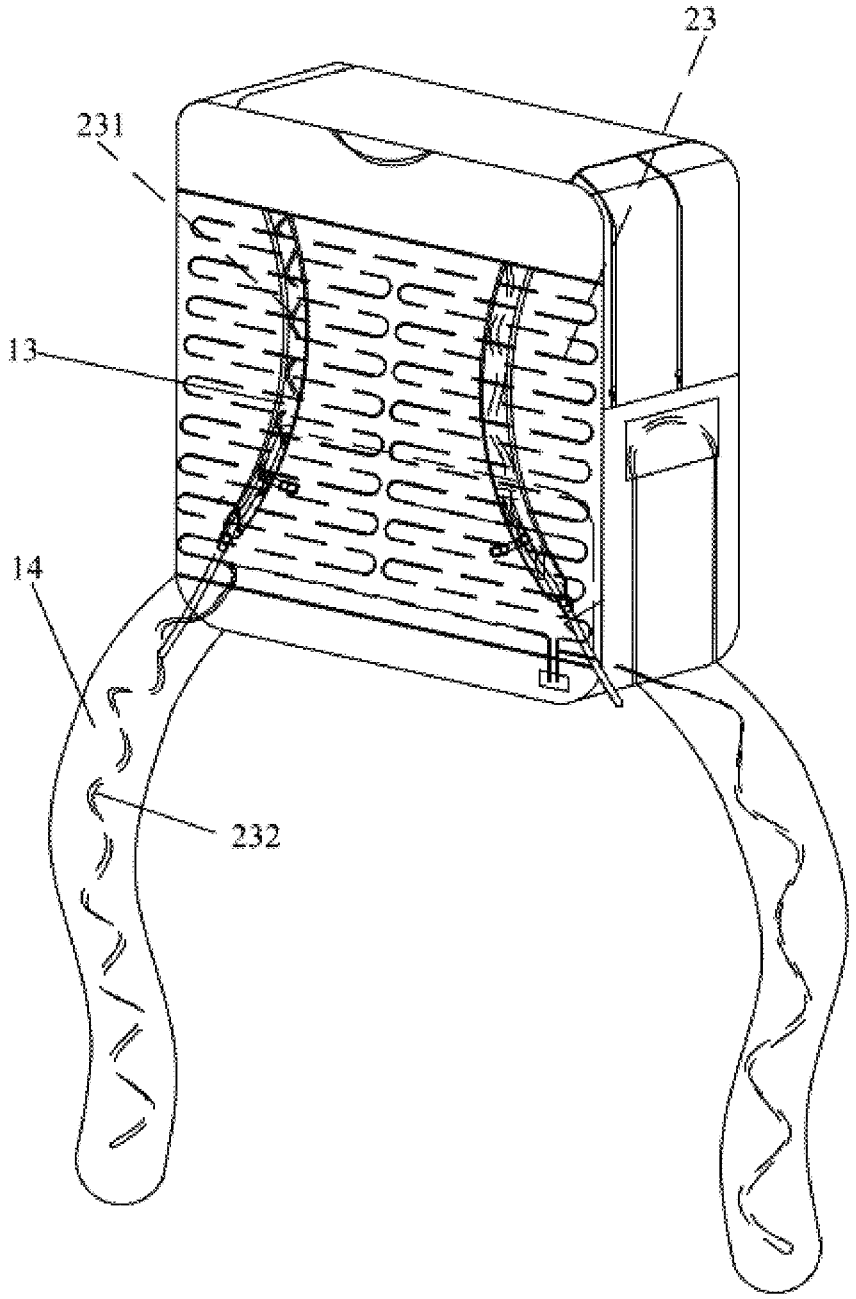
FIG. 4 is a schematic view of the circulating pipe, the shoulder branch pipes pipe and the waist branch pipes in the present invention.

Preferably, referring to FIG. 4, the circulating pipe 23 is provided with the shoulder branch pipe 231 and the waist branch pipe 232 which are connected with it. The shoulder branch pipe 231 is accommodated in the interlayer, closing to wearer's bank, of the shoulder strap 13. The waist branch pipe 232 is accommodate in the interlayer, closing to wearer's bank, of the waist strap.

Preferably, the tank is also provided with a temperature sensor to detect the liquid temperature, the circuit board is provided with a control system, when the liquid temperature is lower than the set value in the control system, the control system controls the circuit board 25 to stop supplying power to the semiconductor refrigeration chip 21, and stop cooling, when the liquid temperature is higher than the set value, the control system starts the circuit board 25 to supply power to the semiconductor refrigeration chip 21 and performs refrigeration.

The above is a further detailed description of the present invention in combination with a specific preferred embodiment, and it can not be determined that the specific embodiments of the present invention are confined to these descriptions. For the general technical personnel in the technical field of the invention, under the premise that is not divorced from the conception of the invention, the form of the structure can be flexible and changeable, and a series of products can be derived. Only a few simple deductions or substitutions shall be deemed as belonging to the scope of patent protection determined by the claims submitted by the present invention.

What is claimed is:

1. A knapsack with a cooling device, comprising a knapsack body and a cooling device, wherein said cooling device comprises a semiconductor chilling plate, a radiating assembly, a circulating pipe, a tank and a circuit board; wherein the knapsack body comprises a first chamber; said circuit board is externally connected with a power supply; said circuit board is electronically connected with said semiconductor chilling plate and said radiating assembly, said semiconductor chilling plate is disposed at one side of said tank to cool liquid of said tank; said radiating assembly is disposed at one side of said semiconductor chilling plate to dissipate heat, said tank is connected with said circulating pipe; said circulating pipe consists of multiple curved U type units that connect with each other; the back of said knapsack body is provided with an interlayer; said multiple curved U type units are tiled in said interlayer;

wherein said circulating pipe is provided with shoulder branch pipes connected with said circulating pipe, said knapsack is provided with a shoulder belt; the back of said shoulder belt, on the side closer to wearer's body, is provided with an interlayer of said shoulder belt; said shoulder branch pipes are contained in said interlayer of said shoulder belt;

wherein said semiconductor chilling plate, said radiating assembly, said tank and said circuit board are accommodated in said first chamber.

2. A knapsack with a cooling device according to claim 1, wherein said radiating assembly comprises a micro fan, a micro liquid pump and a radiator; said circuit board is electrically connected with said micro fan and said micro liquid pump; two ends of said circulating pipe are respectively connected with said tank and said micro liquid pump, said micro liquid pump is connected with said tank; said power supply drives said micro fan to rotate so as to cool said radiator; said radiator cools said semiconductor chilling plate; said micro liquid pump drives liquid to circulate in said tank and said circulating pipe.

3. A knapsack with a cooling device according to claim 2, wherein said radiating assembly also comprises a shell; said radiator, said micro liquid pump and said tank are contained in said shell; said shell is provided with fan mounting hole, said micro fan is installed on said fan mounting hole and on the outer side of said radiator.

4. A knapsack with a cooling device according to claim 3, wherein a water inlet is arranged on said tank.

5. A knapsack with a cooling device according to claim 1, wherein said circulating pipe is also provided with waist branch pipes connected with said circulating pipe; said knapsack is provided with a waist band; the back of said waist band, on the side closer to wearer's body, is provided with a waist interlayer; said waist branch pipes are contained in said waist interlayer.

6. A knapsack with a cooling device according to claim 1, wherein said circuit board is provided with a USB connecting line, which is externally connected with the power supply.

7. A knapsack with a cooling device according to claim 1, wherein the inside of said knapsack body is equipped with an interlay which separates the lumen of said knapsack into the first chamber and the second chamber; the first chamber has two sides, each of which includes a zipper.

* * * * *